US010994560B2

(12) United States Patent
Teoh et al.

(10) Patent No.: US 10,994,560 B2
(45) Date of Patent: May 4, 2021

(54) PRINT MEDIA AMOUNT DETERMINATION

(71) Applicant: Hewlett-Packard Development Company, L.P., Spring, TX (US)

(72) Inventors: Wei Lit Teoh, Singapore (SG); Li-Wen Benedict Tan, Singapore (SG); Eugene Goh, Singapore (SG); Angel Astorgano-Ballesteros, Vancouver, WA (US); Ken Ko, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/634,953

(22) PCT Filed: Jul. 31, 2017

(86) PCT No.: PCT/US2017/044604
§ 371 (c)(1),
(2) Date: Jan. 29, 2020

(87) PCT Pub. No.: WO2019/027410
PCT Pub. Date: Feb. 7, 2019

(65) Prior Publication Data

US 2020/0238734 A1 Jul. 30, 2020

(51) Int. Cl.
*B41J 13/00* (2006.01)
*B65H 7/02* (2006.01)
(Continued)

(52) U.S. Cl.
CPC ..... *B41J 13/0009* (2013.01); *B41F 21/05* (2013.01); *B41J 13/103* (2013.01); *B41J 13/16* (2013.01);
(Continued)

(58) Field of Classification Search
CPC ..... B41J 13/0009; B41J 13/103; B41J 13/16; B41F 21/05; B65H 1/04; B65H 1/08; B65H 3/0684; B65H 7/02; B65H 7/04; B65H 2511/30; B65H 2511/417; B65H 2515/32; B65H 2220/01
See application file for complete search history.

(56) References Cited

U.S. PATENT DOCUMENTS 5,527,026 A * 6/1996 Padget ..... B65H 1/08 271/117
5,547,181 A * 8/1996 Underwood ..... B65H 3/0615 271/114
(Continued)

FOREIGN PATENT DOCUMENTS

JP 3227850 6/1994

*Primary Examiner* — Anh T Vo
(74) *Attorney, Agent, or Firm* — HP Inc. Patent Department

(57) ABSTRACT

The present subject matter describes determination of amount of print media present in an input tray of a printing system. In an example implementation of the present subject matter, a current operating torque of a motor that moves a pick arm for drawing print media from the input tray is monitored. The current operating torque is monitored while the pick arm is moved between a rest position and a pick-ready position. Based on the monitored operating torque, it is determined whether amount of print media present in the input tray is one of below and above a predefined amount of print media.

15 Claims, 6 Drawing Sheets

(51) Int. Cl.

| | |
|---|---|
| ***B41J 13/10*** | (2006.01) |
| ***B65H 1/04*** | (2006.01) |
| ***B65H 7/04*** | (2006.01) |
| ***B41F 21/05*** | (2006.01) |
| ***B65H 1/08*** | (2006.01) |
| ***B41J 13/16*** | (2006.01) |
| ***B65H 3/06*** | (2006.01) |

(52) U.S. Cl.
CPC ..... *B65H 1/04* (2013.01); *B65H 1/08* (2013.01); *B65H 3/0684* (2013.01); *B65H 7/02* (2013.01); *B65H 7/04* (2013.01)

(56) References Cited

U.S. PATENT DOCUMENTS

| | | | | |
|---|---|---|---|---|
| 5,552,859 | A * | 9/1996 | Nakagawa | B65H 3/62 271/110 |
| 5,622,364 | A * | 4/1997 | Dutton | B65H 7/00 271/117 |
| 6,217,018 | B1 * | 4/2001 | Tay | B65H 1/266 271/145 |
| 6,352,256 | B1 | 3/2002 | Hsieh | |
| 7,325,801 | B2 | 2/2008 | Marra, III et al. | |
| 7,374,163 | B2 | 5/2008 | Cook et al. | |
| 7,568,850 | B2 | 8/2009 | Bingham | |
| 7,594,647 | B2 | 9/2009 | DeVore et al. | |
| 2005/0275150 | A1 | 12/2005 | Cook | |
| 2009/0127766 | A1 | 5/2009 | Nakaishi | |
| 2016/0355361 | A1 | 12/2016 | Arai et al. | |

* cited by examiner

PRINT MEDIA AMOUNT DETERMINATION

BACKGROUND

Amount of print media in an input tray of a printing system is determined so that print media can be replenished in a timely manner. When amount of print media in the input tray is indicated to be low, a user/operator may reload print media in the input tray.

BRIEF DESCRIPTION OF DRAWINGS

The following detailed description references the drawings, wherein.

DETAILED DESCRIPTION

Figure 1:
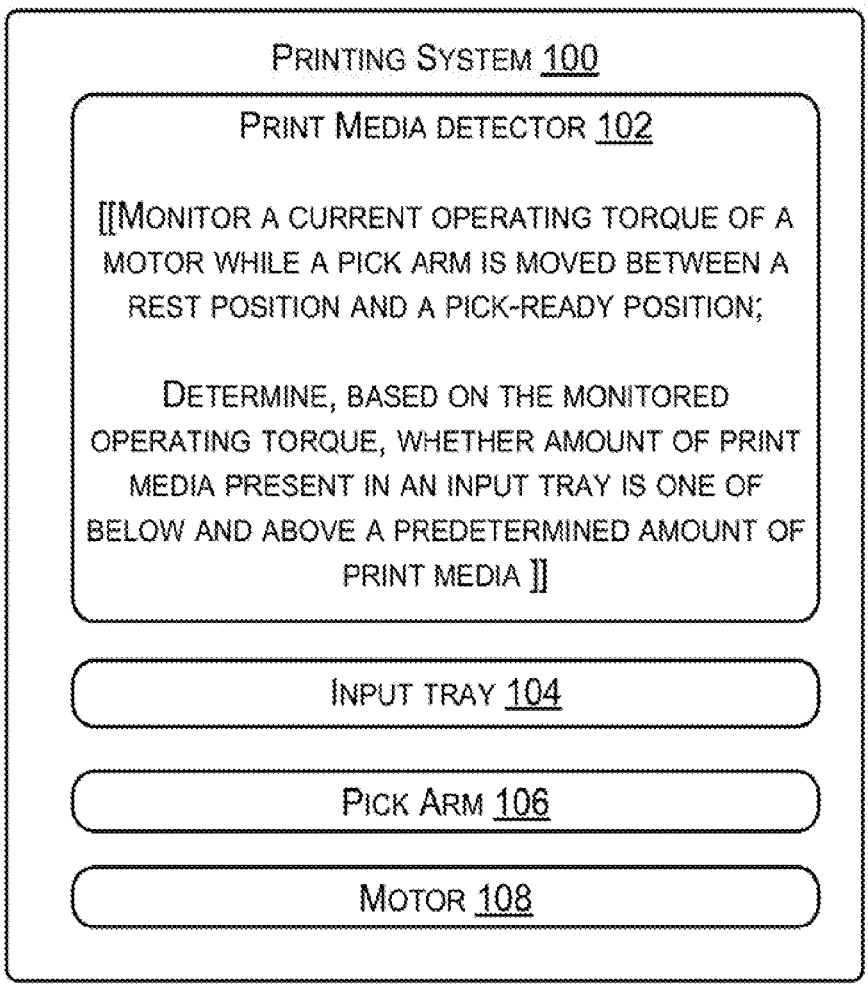
FIG. 1 illustrates a printing system having a print media detector, according to an example implementation of the present subject matter.

The present subject matter describes determining amount of print media, such as paper, present in an input tray of a printing system. The printing system includes a pick arm and a motor to drive the pick arm for drawing print media from the input tray.

The amount of print media present in the input tray is generally detected by sensors, for example, opto-interrupter sensors or reflectance sensors positioned in the input tray. The sensors may detect a height of a stack of the print media and provide information of the sensed height to a control unit of the printing system. The control unit based on the information of the sensed height may determine the amount of print media present in the input tray. The control unit may also regulate operation of the motor that drives the pick arm based on the determined amount of print media present in the input tray. The determined amount of print media may also be used by the control unit for sequencing or scheduling different operations of the printing system, such as pick, feed, and discharge of print media.

Mounting and assembling of sensors in the input tray involves complex arrangement of sensor sub-systems which makes the printing system complex and bulky. Also, the sensor sub-systems often include small and fragile mechanical parts, which may get damaged during handling and assembly. Due to the complexity in assembly of the sensors and risk of damaging of the sensors, there may be chances of improper assembly of the sensors which may give rise to faults in sensing the amount of the print media. Further, the sensors used in the printing system are expensive and adds to the overall cost of the printing system.

Also, electrical interconnects or wires may be used for making connections between the sensors and other internal components of the printing system. These electrical interconnects may be fragile and may get damaged easily, which may affect the reliability of determination of the amount of the print media. Further, the use of robust electrical interconnects may increase the cost of the printing system.

The present subject matter describes methods and printing systems for determining whether amount of print media present in the input tray is either below and above a predefined amount. Such a determination is carried out without the use of sensors. Thus, the printing systems of the present subject matter are less bulky, have a less complex assembly, and are modular as compared to the printing systems with print media height detection sensors. The elimination of the print media height detection sensors also enables reduction of cost of the printing systems.

In accordance with an example implementation of the present subject matter, a current operating torque of a motor that moves a pick arm for drawing print media from an input tray of a printing system is monitored. The current operating torque may be defined as the instantaneous output torque of the motor for moving the pick arm. The current operating torque is monitored while the pick arm is moved between a rest position and a pick-ready position. The rest position of the pick arm is a position at which the pick arm remains substantially parallel to the input tray. The pick arm remains in the rest position when the printing system is in an idle state and no printing operation is carried out by the printing system. In the rest position, the pick arm is not in contact with print media present in the input tray. At the pick-ready position, the pick arm remains in touch with print media present in the input tray and may be operated to draw the print media from the input tray inside the printing system. When the printing system is carrying out a printing operation, the pick arm remains in the pick-ready position for transferring print media inside the printing system. After completion of the printing operation the pick arm may be lifted by the motor from the pick-ready position to the rest position. The operating torque of the motor to lift the pick arm from the pick-ready position to the rest position varies depending on the amount/height of print media present in the input tray. In an example implementation, the operating torque of the motor may be monitored when the pick arm is moved from the pick-ready position to the rest position. With the method and systems of the present subject matter, it may be determined, based on the monitored operating torque, whether amount of print media present in the input tray is one of below and above a predefined amount of print media.

Determination of the amount of print media based on the monitored operating torque of the motor allows elimination of print media height detection sensors. The elimination of such sensors reduces complexity in assembly of the printing systems and makes the printing systems modular. Also, the risks associated with the sensors getting damaged during handling or assembly and consequent faults in detection of amount of print media is minimized. Thus, the printing systems of the present subject matter are robust and enable in reliable determination of amount of the print media present in the input tray.

Further, elimination of print media height detection sensors may also eliminate the use of electrical interconnects for the sensors. Elimination of the electrical interconnects further enhances the modularity of the printing systems. Also, without the sensors and their electrical interconnects, the manufacturing cost of the printing systems of the present subject matter is reduced as compared to printing systems with the sensors.

The following detailed description refers to the accompanying drawings. Wherever possible, the same reference numbers are used in the drawings and the following description to refer to the same or similar parts. While several examples are described in the description, modifications, adaptations, and other implementations are possible. Accordingly, the following detailed description does not limit the disclosed examples. Instead, the proper scope of the disclosed examples may be defined by the appended claims.

FIG. 1 illustrates a printing system 100 having a print media detector 102, according to an example implementation of the present subject matter. The printing system 100, also referred to as the system 100, may be an inkjet printer or any other type of printer having a pick arm mechanism for picking and driving print media.

In an example implementation, the print media detector 102 may be implemented through a combination of any suitable hardware and computer-readable instructions. The print media detector 102 may be implemented in a number of different ways to perform various functions for the purposes of determining amount of print media loaded in the system 100. For example, the computer-readable instructions for the print media detector 102 may be processor-executable instructions stored in a non-transitory computer-readable storage medium, and the hardware for the print media detector 102 may include a processing resource (e.g., processor(s)), to execute such instructions. In the present examples, the non-transitory computer-readable storage medium stores instructions which, when executed by the processing resource, implements the print media detector 102. The system 100 may include the non-transitory computer-readable storage medium storing the instructions and the processing resource (not shown) to execute the instructions. In an example, the non-transitory computer-readable storage medium storing the instructions may be external, but accessible to the processing resource of the system 100. The non-transitory computer-readable storage medium may include, for example, volatile memory (e.g., RAM), and/or non-volatile memory (e.g., EPROM, flash memory, NVRAM, memristor, etc.). In another example, the print media detector 102 may be implemented by electronic circuitry.

The printing system 100 includes an input tray 104. The input tray 104 may be an L-tray, an accessory tray, or the like. Print media, such as sheets of paper may be loaded on the input tray 104. The print media may include, for example, plain paper or photo paper and may be of A3 or A4 size, or such.

The printing system 100 includes a pick arm 106. The pick arm 106 may be moved for drawing print media from the input tray 104. In an example implementation, the pick arm 106 may be rotated for transferring the print media from the input tray 104 into a media-path of the printing system 100. The media-path may be a pathway, from an input tray, such as the input tray 104, to a discharge unit (not shown) in the printing system along which the print media may be transferred for printing.

The printing system 100 further includes a motor 108. In an example implementation, the motor 108 may be a pick motor coupled to the pick arm 106. In another example implementation, the motor 108 may be a multi-purpose motor that may operate as a primary feed motor for feeding print media to a printing unit (not shown) of the printing system 100 and also operate as a pick motor coupled to the pick arm, to drive the pick arm 106.

In an example implementation, the print media detector 102 may include an encoder (not shown). The encoder may be, for example, a rotary encoder. The encoder may be coupled to a shaft of the motor 108 and may indicate angular position of the shaft of the motor 108 in terms of an encoder count which may be stored in a memory by the print media detector 102. The print media detector 102 may also be configured to measure an output torque of the motor 108.

In an example implementation, the print media detector 102 is coupled to the motor 108 and the operation of the motor 108 may be controlled by the print media detector 102. In an example implementation, the print media detector 102 may generate control instructions in the form of Pulse Width Modulation (PWM) signals to rotate the motor 108.

In an example implementation, the motor 108 is operated to move the pick arm 106 between a rest position and a pick-ready position. The rest position of the pick arm 106 is a position at which the pick arm 106 remains substantially parallel to the input tray 104. In the rest position, the pick arm 106 does not come in contact with print media present in the input tray 104. At the pick-ready position, the pick arm 106 remains in contact with print media present in the input tray 104 and may be operated by the motor 108 to draw print media from the input tray 104.

While the pick arm 106 is moved between the rest position and the pick-ready position, the print media detector 102 monitors a current operating torque of the motor 108. In an example implementation, the print media detector 102 may start monitoring the current operating torque of the motor after a specific number of rotations of the motor 108. The specific number of rotations may be measured from a time instance when the motor 108 starts to move the pick arm 106 from the rest position. The specific number of rotations may be expressed in terms of a number of encoder counts of the motor 108. In an example implementation, for ink-jet printers, the specific number of rotations may be pre-set and stored in the memory of the printing system 100. The specific number of rotations may range between 3000 encoder counts and 3500 encoder counts.

The print media detector 102 determines, based on the monitored operating torque, whether amount of print media present in the input tray 104 is one of below and above a predefined amount of print media. The predefined amount of print media refers to a specific number of print media below which an indication of low print media is desirable from the printing system 100. In an example implementation, the predefined amount of print media may correspond to 15 sheets to 20 sheets of plain A4 paper or 7 sheets to 10 sheets of photographic paper. An example procedure of determining amount of print media in an input tray, such as the input tray 104, is described in detail with reference to FIG. 2.

Figure 2:
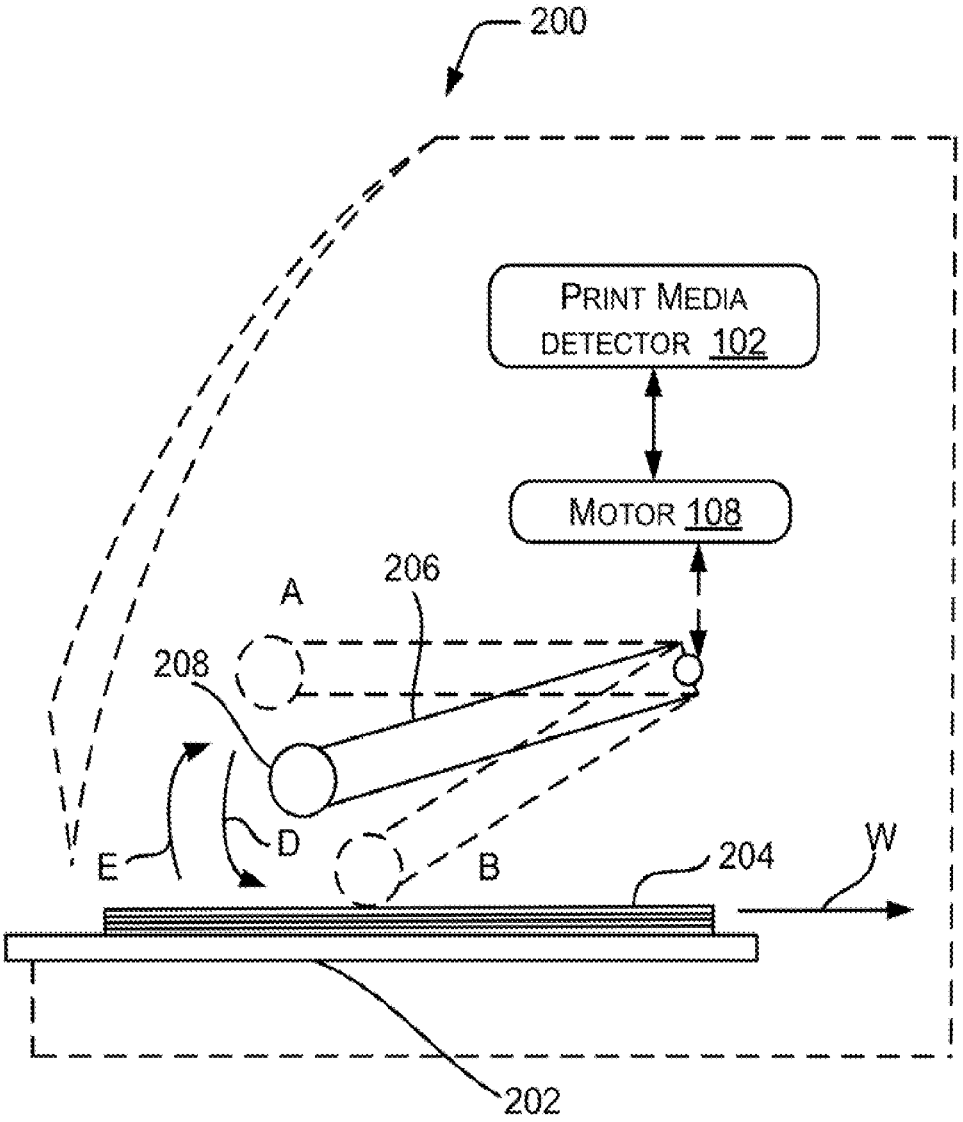
FIG. 2 illustrates a printing system having the print media detector, according to an example implementation of the present subject matter.

FIG. 2 illustrates a printing system 200 having the print media detector 102, according to an example implementation of the present subject matter. The printing system 200 includes an input tray 202 similar to the input tray 104 of the printing system 100. The input tray 202 may be loaded with print media 204.

The printing system 200 also includes a pick arm 206, similar to the pick arm 106 of the printing system 100. The printing system 200 also includes the motor 108. The pick arm 206 may be coupled to the motor 108 which may be operated to move the pick arm 206. As shown in FIG. 2, the pick arm 206 also bears a pick roller 208 at one end. The pick roller 208 may be rotated to transfer paper inside the printing system 200 during printing.

In an example implementation, the motor 108 may be operated to rotate the pick arm 206 between a position A and a position B, as illustrated in FIG. 2. The position A of the pick arm 206 is termed as a rest position where the pick arm 206 is held during an idle state of the printing system 200, i.e., when the printing system 200 is not printing. In an example implementation, the printing system 100 may include mechanical stops and buffers (not shown) to hold the pick arm 206 at the rest position A. As may be appreciated from FIG. 2, when the pick arm 206 is at the rest position A, the pick arm 206 does not come in contact with the print media 204 loaded in the input tray 202.

The position B of the pick arm 206 is termed as a pick-ready position where the pick arm 206 is held while the printing system 200 performs a printing operation. In an example implementation, the motor 108 may be coupled to the pick arm 206 through a cam arrangement (not shown). Rotation of the motor 108 effectuates movement of the cam arrangement which in turn results in rotation of the pick arm 206 between the rest position A and the pick-ready position B.

Upon initiation of a printing operation, the motor 108 rotates to move the pick arm 206, in a direction, as indicated by arrow D, from the rest position A towards the pick-ready position B. When the pick arm 206 reaches the pick-ready position B, further rotation of the pick arm 206 in the direction, as indicated by arrow D, is stopped as the pick arm 206 comes in contact and presses down against print media 204 loaded in the input tray 202. When the pick arm 206 is at the pick-ready position B, the pick roller 208 rotates to transfer paper in a direction, as indicated by arrow W, towards an image forming unit (not shown) of the printing system 200 for printing.

On completion of the printing operation, the pick-arm 206 may be moved from the pick-ready position B back to the rest position A, in a direction of arrow E. Movement of the pick arm 206 from the pick-ready position B to the rest position A may be a pre-scheduled operation of the printing system 200. An operating torque of the motor 108 to move the pick arm 206 from the pick-ready position B to the rest position A depends on a height/amount of a stack of print media present in the input tray 202. Greater the height/amount of the stack of print media present in the input tray 202, lesser torque is required to lift the pick arm 206 and hence value of the operating torque of the motor 108 to lift the pick arm 206 from the pick-ready position B is lower.

A peak magnitude value of the operating torque of the motor 108, to lift the pick arm 206 from the pick-ready position B when the pick arm 206 rests on a predefined amount of print media, is referred to as a torque threshold. The predefined amount of print media refers to a specific number of print media below which an indication of low print media is desirable from the printing system 200. In an example implementation, the predefined amount of print media ranges between 10 sheets to 20 sheets of plain A4 paper, and the torque threshold ranges between 15 ounce-inches to 20 ounce-inches. The torque threshold may be predetermined and stored in a memory (not shown) of the printing system 200.

A number of rotations of the motor 108 to move the pick arm 206 from the pick-ready position B to the rest position A may be recorded at a time instance when the pick arm 206 reaches the rest position A and may be stored in the memory. The number of rotations of the motor 108 to move the pick arm 206 from the pick-ready position B to the rest position A depends on a height/amount of a stack of print media present in the input tray 202. Greater the height/amount of the stack of print media present in the input tray 202, lower is the number of rotations of the motor 108 to move the pick arm 206 from the pick-ready position B to the rest position A.

Therefore, height/amount of a stack of print media present in the input tray 202 may be expressed in terms of number of rotations of the motor 108 to move the pick arm 206 from the pick-ready position B to the rest position A. Thus, in an example implementation, the predefined amount of print media may correspond to a predetermined stack height threshold which may be expressed as ranging between 4000 encoder counts to 4500 encoder counts. In an example implementation, the predetermined stack height threshold may be calculated by measuring a number of rotations of the motor 108 to move the pick arm 206 from the pick-ready position B to the rest position B with the predefined amount of print media loaded in the input tray 202. The predetermined stack height threshold may be preset and stored in the memory (not shown) of the printing system 200.

In an example implementation, a predetermined stack height error threshold may also be preset and stored in the memory of the printing system 200, where the predetermined stack height error threshold is less than the predetermined stack height threshold. In an example implementation, the predetermined stack height error threshold corresponds to a height of a specific amount of print media which is lesser in number than the predefined amount of print media. In an example implementation, the specific amount of print media may range between 5 sheets to 10 sheets of plain A4 paper.

The following description describes in detail an example procedure of determination of the amount of print media 204 present in the input tray 202.

Consider that the printing system 200 is in an idle state and the pick arm 206 is held at the rest position A. The printing system 200 may receive a print command from an electronic device, say a computer or a smart phone. On receiving the print command, the printing system 200 initiates a print operation. During operation of the printing system 200, the print media detector 102 operates the motor 108 to rotate the pick arm 206 from the rest position A towards the pick-ready position B along a direction, as indicated by arrow D. On reaching the pick-ready position B, the pick roller 208 rotates to move print media in a direction arrow W and the printing operation is carried out. As the printing operation is carried out, amount of print media 204 in the input tray 202 is gradually depleted.

On completion of the printing operation, the pick arm 206 is rotated from the pick-ready position B to the rest position A in a direction of arrow E. While the pick arm 206 is moved towards the rest position A from the pick-ready position B, the print media detector 102 monitors a current operating torque of the motor 108.

In an example implementation, the print media detector 102 starts monitoring the current operating torque after a specific number of rotations of the motor 108 from a time instance when the motor 108 starts to move the pick arm from the rest position A towards the pick-ready position B. The specific number of rotations may be 3000 encoder counts to 3500 encoder counts. The specific number of rotations may be pre-set and stored in the memory (not shown) of the printing system 200. The print media detector 102 determines whether the motor 108 has completed the specific number of rotations. Upon determining that motor 108 has completed the specific number of rotations, the print media detector 102 compares the current operating torque of the motor 108 with the torque threshold.

When a magnitude of the current operating torque of the motor 108 is one of equal to and above the torque threshold, the print media detector 102 determines that the amount of print media present in the input tray 202 is below the predefined amount of print media. As the motor 108 is rotated to move the pick arm 206 in the direction of arrow E, the pick arm 206 gradually reaches the rest position A and stops. When the pick arm 206 reaches the rest position A and a magnitude of the current operating torque of the motor 108 remains below the torque threshold, the print media detector 102 determines that the amount of print media present in the input tray 202 is above the predefined amount of print media. Thus, based on the monitored operating torque of the motor 108, the print media detector 102 may determine whether the amount of print media 204 present in the input tray 202 is one of below and above the predefined amount of print media.

In an example implementation, on determining that amount of print media 204 present in the input tray 202 is below the predefined amount of print media, the print media detector 102 may generate a visual indication to notify a user that print media level is low. The visual indication may be in the form of a "Low on Paper" message displayed in a display unit (not shown) of the printing system 200 or by flashing a Light Emitting Diode (LED) to signal low paper status in the printing system 200.

In another example implementation, the print media detector 102 captures a snapshot indicative of a number of rotations of the motor 108 to move the pick arm from the pick-ready position B to the rest position A. In an example implementation, the captured snapshot is an encoder count of a number of rotations of the motor 108 to move the pick arm 206 from the pick-ready position B to the rest position A.

The print media detector 102 determines a current print media stack height in the input tray 202 corresponding to the captured snapshot. The current print media stack height is directly proportional to the captured snapshot and is expressed in terms of encoder counts.

The print media detector 102 compares the current print media stack height with the predetermined stack height threshold. When the current print media stack height is greater than the predetermined stack height threshold, the print media detector 102 identifies that the determination of the amount of print media to be below the predefined amount of print media is incorrect and determines that the amount of print media present in the input tray 202 is above the predefined amount of print media.

When the current print media stack height is less than the predetermined stack height threshold the print media detector performs an error check. In an example implementation, for the purpose of performing the error check, the print media detector 102 compares the current print media stack height with the predetermined stack height error threshold. In an example implementation, the predetermined stack height error threshold is expressed in terms of number of rotations of the motor 108 and ranges between 3900 encoder counts to 4000 encoder counts.

When the current print media stack height is less than the predetermined stack height error threshold, the print media detector 102 confirms that the determination of the amount of print media to be below the predefined amount of print media is correct.

When the current print media stack height is greater than the predetermined stack height error threshold, the print media detector 102 operates the motor 108 to move the pick arm 206 between the rest position A and the pick-ready position B for a predefined number of cycles. In an example implementation, the predefined number of cycles is three.

In each of the predefined number of cycles, the current operating torque of the motor 108 is monitored and a snapshot indicative of the number of rotations of the motor 108 is captured when the current operating torque equals the torque threshold. Thus, on completion of the predefined number of cycles, a plurality of snapshots may be captured, where each snapshot is indicative of a number of rotations of the motor when the current operating torque equals the torque threshold in each of the predefined number of cycles.

The print media detector 102 determines a print media stack height sample corresponding to each of the plurality snapshots. In an example implementation, the print media stack height sample is directly proportional to a value of the corresponding snapshots expressed in terms of encoder counts.

The print media detector 102 compares each of the plurality of print media stack height samples with the predetermined stack height threshold. Based on the comparison, the print media detector 102 estimates the amount of print media present in the input tray 202 as one of below and above the predefined amount of print media. In an example implementation, when at least 65% to 70% of the print media stack height samples is less than the predetermined stack height threshold, the print media detector 102 estimates that the amount of print media present in the input tray 202 is below the predefined amount of print media.

Figure 3:
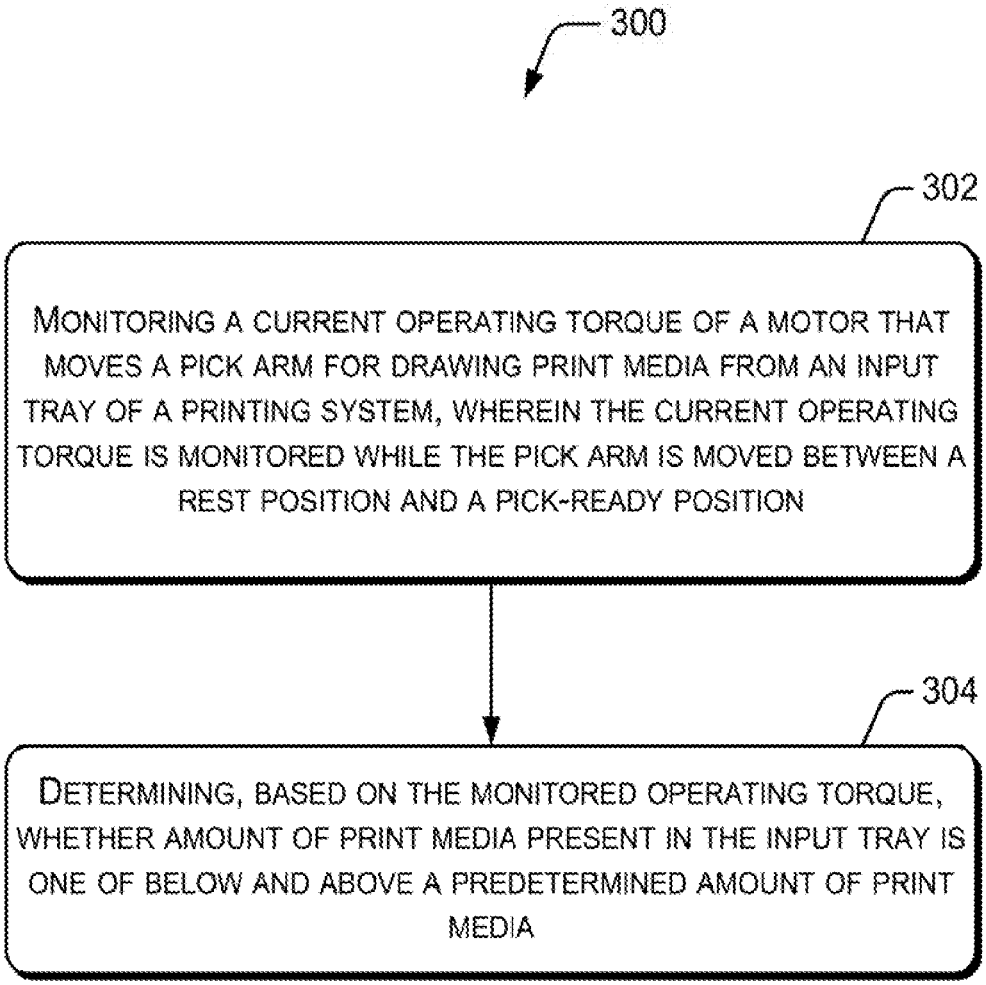
FIG. 3 illustrates a method of determining amount of print media in an input tray of a printing system, according to an example implementation of the present subject matter.

FIG. 3 illustrates a method 300 of determining amount of print media in an input tray of a printing system, according to an example implementation of the present subject matter. The method 300 can be implemented by processor(s) or computing device(s) through any suitable hardware, a non-transitory machine readable medium, or combination thereof. In an example implementation, the method 300 may be performed by a print media detector, such as the print media detector 102, of a printing system, such as the printing system 100. Further, although the method 300 is described in context of the aforementioned printing system 100, other suitable systems may be used for execution of the method 300. It may be understood that processes involved in the method 300 can be executed based on instructions stored in a non-transitory computer readable medium. The non-transitory computer readable medium may include, for example, digital memories, magnetic storage media, such as a magnetic disks and magnetic tapes, hard drives, or optically readable digital data storage media.

Referring to FIG. 3, at block 302, a current operating torque of a motor that moves a pick arm for drawing print media from an input tray of a printing system is monitored. The current operating torque is monitored while the pick arm is moved between a rest position and a pick-ready position. In an example implementation, while the pick arm is moved from the pick-ready position to the rest position, the current operating torque may be monitored.

At block 304, it is determined, based on the monitored operating torque, whether amount of print media present in the input tray is one of below and above a predefined amount of print media. The predefined amount of print media refers to a specific number of print media below which an indication of low print media is desirable from the printing system. In an example implementation, the predefined amount of print media may correspond to 15 sheets to 20 sheets of plain A4 paper or 7 sheets to 10 sheets of photographic paper.

An example technique of determining whether the amount of print media in the input tray is one of below and above a predefined amount of print media is described in detail through FIGS. 4 and 4A.

Figure 4:
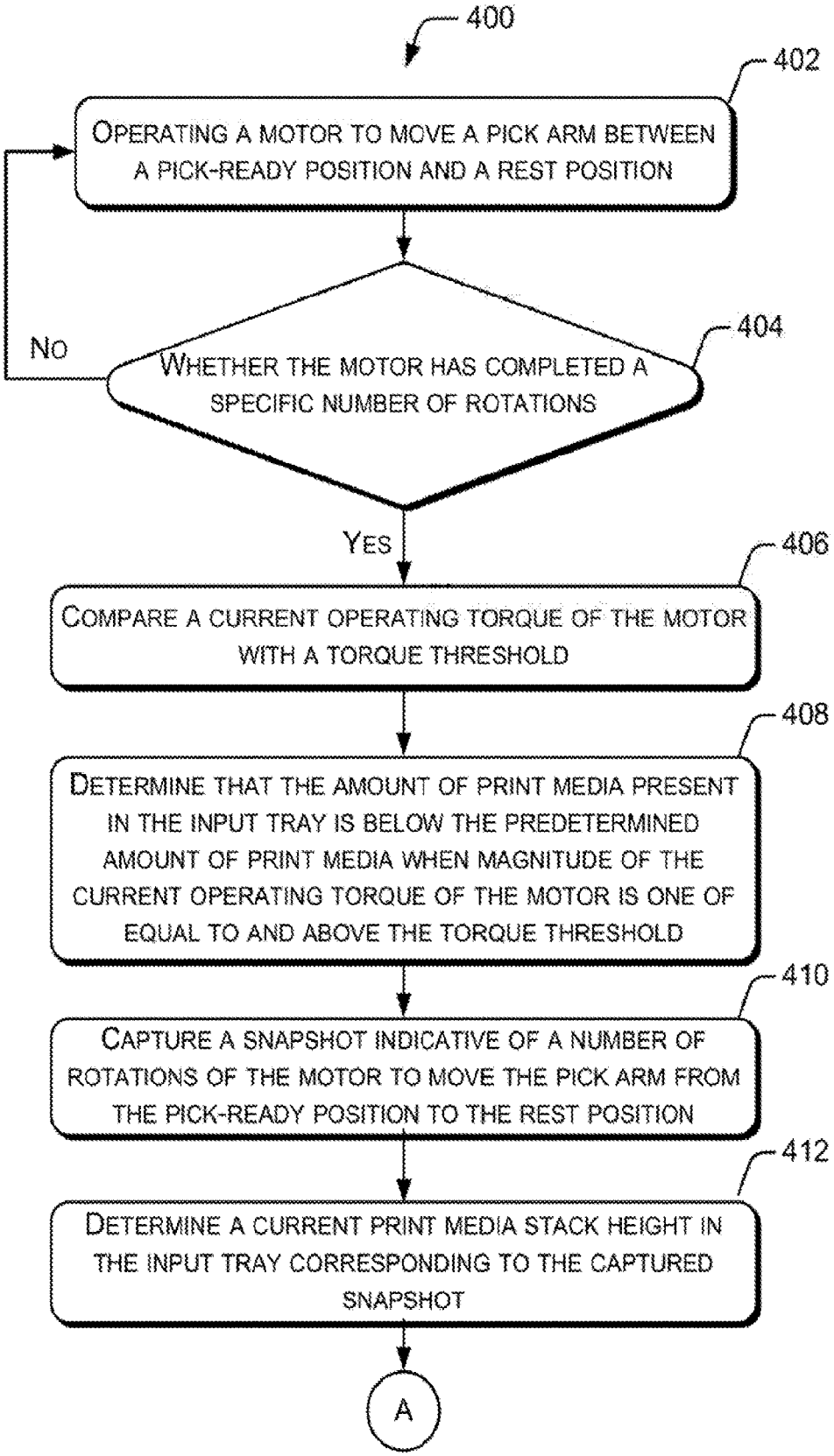
FIGS. 4 and 4A illustrate a method of determining amount of print media in the input tray of the printing system, according to an example implementation of the present subject matter.
Figure 4A:
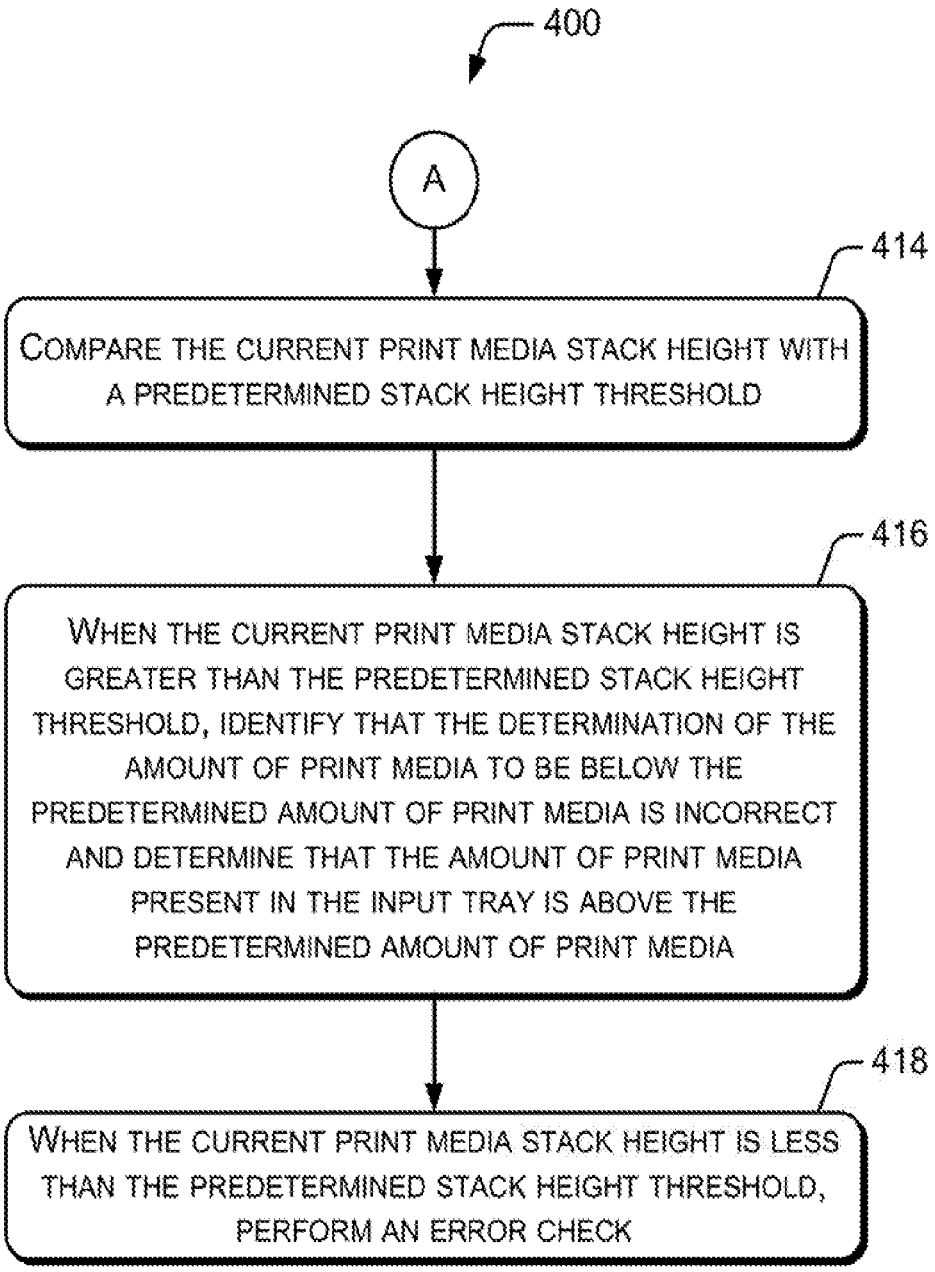

FIGS. 4 and 4A illustrate a method 400 of determining whether an amount of print media is one of below and above the predefined amount of print media, according to an example implementation of the present subject matter. In an example implementation, the method 400 may be performed by a print media detector, such as the print media detector 102, of a printing system, such as the printing system 100 or 200.

At block 402, a motor is operated to move a pick arm between a rest position and a pick-ready position. The rest position of the pick arm is a position at which the pick arm remains substantially parallel to an input tray of the printing system. The pick arm remains in the rest position when the printing system is in an idle state and no printing operation is carried out by the printing system. In the rest position of the pick arm, the pick arm is not in contact with print media present in the input tray. At the pick-ready position, the pick arm remains in touch with the print media present in the input tray and may be operated to draw the print media from the input tray. When the printing system is carrying out a printing operation, the pick arm remains in pick-ready position for transferring print media inside the printing system. After completion of the printing operation the pick arm is lifted from the pick-ready position to the rest position. In an example implementation, the pick arm is rotated to move between the rest position and the pick-ready position.

At block 404, an encoder count of the motor is checked to determine whether the motor has completed a specific number of rotations. The specific number of rotations may be calculated from a time instance when the motor starts to move the pick arm from the rest position. In an example implementation, the specific number of rotations may be pre-set and stored in the memory of the printing system. The specific number of rotations may range between 3000 encoder counts to 3500 encoder counts.

At block 406, when is it determined that the motor has completed the specific number of rotations, a current operating torque of the motor is compared with a torque threshold. The torque threshold is a predetermined torque value of the motor to lift the pick arm from the pick-ready position where, at the pick-ready position, the pick arm rests on a predefined amount of print media present in the input tray. In an example implementation, the predefined amount of print media may correspond to 15 sheets to 20 sheets of plain A4 paper or 7 sheets to 10 sheets of photographic paper and the torque threshold may have a value ranging between 15 ounce-inches to 20 ounce-inches. The torque threshold may be predetermined and stored in a memory (not shown) of the printing system 200.

At block 408, it is determined that the amount of print media present in the input tray is below the predefined amount of print media, when magnitude of the current operating torque of the motor is one of equal to and above the torque threshold. In an example implementation, it may be determined that the amount of print media present in the input tray is above the predefined amount of print media, when the magnitude of the current operating torque is below the torque threshold and the pick arm is at the pick-ready position.

At block 410, a snapshot indicative of a number of rotations of the motor to move the pick arm from the pick-ready position to the rest position is captured.

At block 412, a current print media stack height in the input tray is determined corresponding to the captured snapshot.

At block 414, the current print media stack height is compared with a predetermined stack height threshold. In an example implementation, the predetermined stack height threshold may be expressed as ranging between 4100 encoder counts to 4500 encoder counts.

When the current print media stack height is greater than the predetermined stack height threshold, at block 416, it is identified that the determination of the amount of print media to be below the predefined amount of print media is incorrect and it is determined that the amount of print media present in the input tray is above the predefined amount of print media.

When the current print media stack height is less than the predetermined stack height threshold, at block 418 an error check is performed. A procedure of performing the error check, according to an example implementation, is described below.

The current print media stack height is compared with a predetermined stack height error threshold. The predetermined stack height error threshold is less than the predetermined stack height threshold. In an example implementation, the predetermined stack height error threshold is expressed in terms of number of rotations of the motor and ranges between 3900 encoder counts to 4000 encoder counts.

In an example implementation, when the current print media stack height is less than the predetermined stack height error threshold, it is confirmed that the determination of the amount of print media to be below the predefined amount of print media is correct.

In another example implementation, when the current print media stack height is greater than the predetermined stack height error threshold, the motor is operated to move the pick arm between the rest position and the pick-ready position for a predefined number of cycles. In an example implementation, the predefined number of cycles is three.

A snapshot may be captured in each of the predefined number of cycles, where each snapshot indicates a number of rotations of the motor when the magnitude of the current operating torque equals the torque threshold in each of the predefined number of cycles. Thus, in the predefined number of cycles, a plurality of snapshots may be captured.

A plurality of print media stack height samples may be determined, where each of the plurality of print media stack height samples correspond to each of the plurality snapshots.

Each of the plurality of print media stack height samples may be compared with the predetermined stack height threshold.

Based on the comparison, the amount of print media present in the input tray may be estimated to be one of below and above the predefined amount of print media. In an example implementation, when at least 65% to 70% of the print media stack height samples is less than the predetermined stack height threshold, it is estimated that the amount of print media present in the input tray 202 is below the predefined amount of print media.

Figure 5:
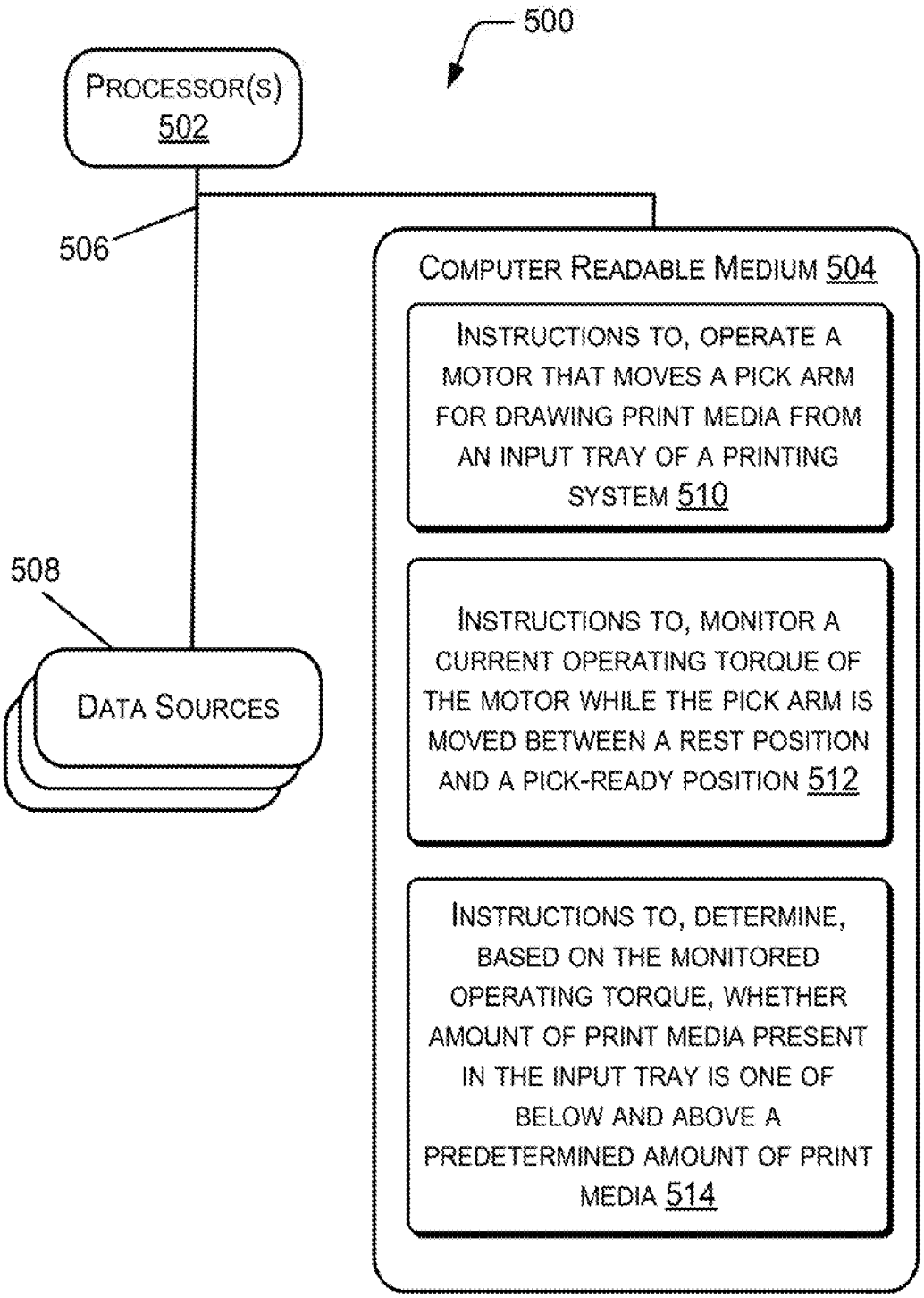
FIG. 5 illustrates a system environment implementing a non-transitory computer readable medium for determination of amount of print media in an input tray of a printing system, according to an example implementation of the present subject matter.

FIG. 5 illustrates a system environment implementing a non-transitory computer readable medium for determination of amount of print media in an input tray of a printing system, according to an example implementation of the present subject matter.

In an example implementation, the system environment 500 includes processor(s) 502 communicatively coupled to a non-transitory computer readable medium 504 through a communication link 506. In an example implementation, the system environment 500 may be a printing system, such as the printing system 100 or 200. In an example, the processor(s) 502 may have one or more processing resources for fetching and executing computer-readable instructions from the non-transitory computer readable medium 504.

The non-transitory computer readable medium 504 can be, for example, an internal memory device or an external memory device. In an example implementation, the communication link 506 may be a direct communication link, such as any memory read/write interface.

The processor(s) 502 and the non-transitory computer readable medium 504 may also be communicatively coupled to data sources 508 over the network. The data sources 508 can include, for example, memory of the printing system, such as the printing system 100 or 200.

In an example implementation, the non-transitory computer readable medium 504 includes a set of computer readable instructions which can be accessed by the processor(s) 502 through the communication link 506 and subsequently executed to perform acts for determining an amount of print media present in an input tray of the printing system, such as the printing system 100 or 200.

Referring to FIG. 5, in an example, the non-transitory computer readable medium 504 includes instructions 510 that cause the processor(s) 502 to operate the motor to move the pick arm. In an example implementation, the pick arm may be rotated to move between a rest position and a pick-ready position.

The non-transitory computer readable medium 504 includes instructions 512 that cause the processor(s) 502 to monitor a current operating torque of the motor while the pick arm is moved between the rest position and the pick-ready position. In an example implementation, the current operating torque of the motor is monitored while the pick arm is moved from the pick-ready position to the rest position. The monitoring may start after a specific number of rotations of the motor from a time instance when the motor starts to move the pick arm from the rest position. In an example implementation, the specific number of rotations may range between 3000 encoder counts and 3500 encoder counts.

In an example implementation, to monitor the current operating torque, the non-transitory computer readable medium includes instructions that cause the processor(s) 502 to determine whether the motor has completed the specific number of rotations.

Upon determining that the motor has completed the specific number of rotations, the non-transitory computer readable medium includes instructions that cause the processor(s) 502 to compare the current operating torque of the motor with a torque threshold. The torque threshold is a predetermined torque value of the motor to lift the pick arm from the pick-ready position, where, at the pick-ready position, the pick arm rests on a predefined amount of print media present in the input tray. In an example implementation, the predefined amount of print media ranges between 15-20 sheets of plain paper and the torque threshold ranges between 15 ounce-inches and 20 ounce-inches.

In an example implementation, the non-transitory computer readable medium 504 includes instructions 514 that cause the processor(s) 502 to determine, based on the monitored operating torque, whether amount of print media present in the input tray is one of below and above the predefined amount of print media.

In an example implementation, the non-transitory computer readable medium 504 includes instructions that cause the processor(s) 502 to determine that the amount of print media present in the input tray is below the predetermined amount of print media when magnitude of the current operating torque of the motor is one of equal to and above the torque threshold. In another example implementation, the non-transitory computer readable medium 504 includes instructions that cause the processor(s) 502 to determine that the amount of print media present in the input tray is above the predetermined amount of print media when magnitude of the current operating torque of the motor is below the torque threshold and the pick arm is at the pick-ready position.

In an example implementation, the non-transitory computer readable medium 504 includes instructions that cause the processor(s) 502 to capture a snapshot indicative of a number of rotations of the motor to move the pick arm from the pick-ready position to the rest position. The non-transitory computer readable medium 504 includes instructions that may also cause the processor(s) 502 to determine a current print media stack height in the input tray corresponding to the captured snapshot. Further, the non-transitory computer readable medium 504 includes instructions that may cause the processor(s) 502 to compare the current print media stack height with a predetermined stack height threshold. The predetermined stack height threshold corresponds to a height of the predefined amount of print media loaded in the input tray.

Further, the non-transitory computer readable medium 504 includes instructions that cause the processor(s) 502 to identify that the determination of the amount of print media to be below the predetermined amount of print media is incorrect and determine that the amount of print media present in the input tray is above the predetermined amount of print media, when the current print media stack height is greater than the predetermined stack height threshold. The non-transitory computer readable medium 504 includes instructions that cause the processor(s) 502 to perform an error check, when the current print media stack height is less than the predetermined stack height threshold.

In an example implementation, the non-transitory computer readable medium 504 includes instructions that cause the processor(s) 502 to perform the error check, according to method(s) described earlier in conjunction with description of FIGS. 4 and 4A. In an example implementation, the non-transitory computer readable medium 504 includes instructions that cause the processor(s) 502 to compare the current print media stack height with a predetermined stack height error threshold. The predetermined stack height error threshold is less than the predetermined stack height threshold. The non-transitory computer readable medium 504 includes instructions that cause the processor(s) 502 to confirm that the determination of the amount of print media to be below the predetermined amount of print media is correct, when the current print media stack height is less than the predetermined stack height error threshold. The non-transitory computer readable medium 504 includes instructions that cause the processor(s) 502 to, operate the motor to move the pick arm between the rest position and the pick-ready position for a predetermined number of cycles, when the current print media stack height is greater than the predetermined stack height error threshold.

Further, the non-transitory computer readable medium 504 includes instructions that cause the processor(s) 502 to capture a plurality of snapshots in the predetermined number of cycles. Each snapshot is indicative of a number of rotations of the motor when the current operating torque equals the torque threshold in each of the predetermined number of cycles. The non-transitory computer readable medium 504 includes instructions that cause the processor(s) 502 to determine each of a plurality of print media stack height samples corresponding to each of the plurality snapshots and compare each of the plurality of print media stack height samples with the predetermined stack height threshold. The non-transitory computer readable medium 504 includes instructions that cause the processor(s) 502 to estimate, based on the comparison, the amount of print media present in the input tray to be one of below and above the predetermined amount of print media.

Although implementations of determining amount of print media present in an input tray of a printing system have been described in language specific to structural features and/or methods, it is to be understood that the present subject matter is not limited to the specific features or methods described. Rather, the specific features and methods are disclosed and explained as example implementations for determining amount of print media present in the input tray of the printing system

We claim:

1. A method comprising:

monitoring a current operating torque of a motor that moves a pick arm for drawing print media from an input tray of a printing system, wherein the current operating torque is monitored while the pick arm is moved between a rest position and a pick-ready position, after a specific number of rotations of the motor from a time instance when the motor starts to move the pick arm from the rest position; and determining, based on the monitored current operating torque, whether an amount of print media present in the input tray is one of below and above a predefined amount of print media.

2. The method as claimed in claim 1, wherein the monitoring comprises:

determining whether the motor has completed the specific number of rotations; and upon determining that the motor has completed the specific number of rotations, comparing the current operating torque of the motor with a torque threshold, wherein the torque threshold is a predetermined torque value of the motor to lift the pick arm from the pick-ready position, wherein at the pick-ready position the pick arm rests on the predefined amount of print media.

3. The method as claimed in claim 2, wherein determining whether the amount of print media present in the input tray is one of below and above the predefined amount of print media comprises:

when a magnitude of the current operating torque of the motor is one of equal to and above the torque threshold, determining that the amount of print media present in the input tray is below the predefined amount of print media; and when the magnitude of the current operating torque is below the torque threshold and the pick arm is at the pick-ready position, determining that the amount of print media present in the input tray is above the predefined amount of print media.

4. The method as claimed in claim 1, further comprising:

capturing a snapshot indicative of a number of rotations of the motor to move the pick arm from the pick-ready position to the rest position;

determining a current print media stack height in the input tray corresponding to the captured snapshot;

comparing the current print media stack height with a predetermined stack height threshold;

when the current print media stack height is greater than the predetermined stack height threshold, identifying that the determination of the amount of print media to be below the predefined amount of print media is incorrect and determining that the amount of print media present in the input tray is above the predefined amount of print media; and when the current print media stack height is less than the predetermined stack height threshold, performing an error check.

5. The method as claimed in claim 4, wherein performing the error check comprises:

comparing the current print media stack height with a predetermined stack height error threshold, the predetermined stack height error threshold being less than the predetermined stack height threshold;

when the current print media stack height is less than the predetermined stack height error threshold, confirming that the determination of the amount of print media to be below the predefined amount of print media is correct;

when the current print media stack height is greater than the predetermined stack height error threshold, operating the motor to move the pick arm between the rest position and the pick-ready position for a predefined number of cycles;

capturing a plurality of snapshots, each snapshot being indicative of a number of rotations of the motor when a magnitude of the current operating torque equals a torque threshold in each of the predefined number of cycles;

determining each of a plurality of print media stack height samples corresponding to each of the plurality snapshots;

comparing each of the plurality of print media stack height samples with the predetermined stack height threshold; and estimating, based on the comparison of each of the plurality of print media stack height samples with the predetermined stack height threshold, the amount of print media present in the input tray to be one of below and above the predefined amount of print media.

6. A printing system comprising:

an input tray;

a pick arm for drawing print media from the input tray;

a motor to move the pick arm between a rest position and a pick-ready position; and a print media detector coupled to the motor, wherein the print media detector is to:

operate the motor to move the pick arm;

monitor a current operating torque of the motor while the pick arm is moved between the rest position and the pick-ready position, wherein the current operating torque is monitored after a specific number of rotations of the motor from a time instance when the motor starts to move the pick arm from the rest position; and determine, based on the monitored current operating torque, whether an amount of print media present in the input tray is one of below and above a predefined amount of print media.

7. The printing system as claimed in claim 6, wherein to monitor the current operating torque, the print media detector is to:

determine whether the motor has completed the specific number of rotations; and upon determining that the motor has completed the specific number of rotations, compare the current operating torque of the motor with a torque threshold, wherein the torque threshold is a predetermined torque value of the motor to lift the pick arm from the pick-ready position, wherein at the pick-ready position the pick arm rests on the predefined amount of print media.

8. The printing system as claimed in claim 7, wherein to determine whether the amount of print media present in the input tray is one of below and above the predefined amount of print media, the print media detector is to:

determine that the amount of print media present in the input tray is below the predefined amount of print media when a magnitude of the current operating torque of the motor is one of equal to and above the torque threshold; and determine that the amount of print media present in the input tray is above the predefined amount of print media when the magnitude of the current operating torque of the motor is below the torque threshold and the pick arm is at the pick-ready position.

9. The printing system as claimed in claim 6, wherein the print media detector is to:

capture a snapshot indicative of a number of rotations of the motor to move the pick arm from the pick-ready position to the rest position;

determine a current print media stack height in the input tray corresponding to the captured snapshot;

compare the current print media stack height with a predetermined stack height threshold;

when the current print media stack height is greater than the predetermined stack height threshold, identify that the determination of the amount of print media to be below the predefined amount of print media is incorrect and determine that the amount of print media present in the input tray is above the predefined amount of print media; and when the current print media stack height is less than the predetermined stack height threshold, perform an error check.

10. The printing system as claimed in claim 9, wherein to perform the error check, the print media detector is to:

compare the current print media stack height with a predetermined stack height error threshold, the predetermined stack height error threshold being less than the predetermined stack height threshold;

when the current print media stack height is less than the predetermined stack height error threshold, confirm that the determination of the amount of print media to be below the predefined amount of print media is correct;

when the current print media stack height is greater than the predetermined stack height error threshold, operate the motor to move the pick arm between the rest position and the pick-ready position for a predefined number of cycles;

capture a plurality of snapshots, each snapshot being indicative of a number of rotations of the motor when the current operating torque equals a torque threshold in each of the predefined number of cycles;

determine each of a plurality of print media stack height samples corresponding to each of the plurality snapshots;

compare each of the plurality of print media stack height samples with the predetermined stack height threshold; and estimate, based on the comparison of each of the plurality of print media stack height samples with the predetermined stack height threshold, the amount of print media present in the input tray to be one of below and above the predefined amount of print media.

11. A non-transitory computer-readable medium comprising computer-readable instructions, the computer-readable instructions when executed by a processor, cause the processor to:

operate a motor that moves a pick arm for drawing print media from an input tray of a printing system;

monitor a current operating torque of the motor while the pick arm is moved between a rest position and a pick-ready position, wherein the current operating torque of the motor is monitored after a specific number of rotations of the motor from a time instance when the motor starts to move the pick arm from the rest position; and determine, based on the monitored current operating torque, whether an amount of print media present in the input tray is one of below and above a predefined amount of print media.

12. The non-transitory computer-readable medium as claimed in claim 11, wherein the instructions to monitor the current operating torque when executed by the processor, cause the processor to:

determine whether the motor has completed the specific number of rotations; and upon determining that the motor has completed the specific number of rotations, compare the current operating torque of the motor with a torque threshold, wherein the torque threshold is a predetermined torque value of the motor to lift the pick arm from the pick-ready position wherein at the pick-ready position the pick arm rests on the predefined amount of print media.

13. The non-transitory computer-readable medium as claimed in claim 12, wherein the instructions to determine whether the amount of print media present in the input tray is one of below and above the predefined amount of print media when executed by the processor, cause the processor to:

determine that the amount of print media present in the input tray is below the predefined amount of print media when a magnitude of the current operating torque of the motor is one of equal to and above the torque threshold; and determine that the amount of print media present in the input tray is above the predefined amount of print media when the magnitude of the current operating torque of the motor is below the torque threshold and the pick arm is at the pick-ready position.

14. The non-transitory computer-readable medium as claimed in claim 12, wherein the instructions further cause the processor to:

capture a snapshot indicative of a number of rotations of the motor to move the pick arm from the pick-ready position to the rest position;

determine a current print media stack height in the input tray corresponding to the captured snapshot;

compare the current print media stack height with a predetermined stack height threshold;

when the current print media stack height is greater than the predetermined stack height threshold, identify that the determination of the amount of print media to be below the predefined amount of print media is incorrect and determine that the amount of print media present in the input tray is above the predefined amount of print media; and when the current print media stack height is less than the predetermined stack height threshold, perform an error check.

15. The non-transitory computer-readable medium as claimed in claim 14, wherein the instructions to perform the error check when executed by the processor, cause the processor to:

compare the current print media stack height with a predetermined stack height error threshold, the predetermined stack height error threshold being less than the predetermined stack height threshold;

when the current print media stack height is less than the predetermined stack height error threshold, confirm that the determination of the amount of print media to be below the predefined amount of print media is correct;

when the current print media stack height is greater than the predetermined stack height error threshold, operate the motor to move the pick arm between the rest position and the pick-ready position for a predefined number of cycles;

capture a plurality of snapshots, each snapshot being indicative of a number of rotations of the motor when the current operating torque equals the torque threshold in each of the predefined number of cycles;

determine each of a plurality of print media stack height samples corresponding to each of the plurality snapshots;

compare each of the plurality of print media stack height samples with the predetermined stack height threshold; and estimate, based on the comparison of each of the plurality of print media stack height samples with the predetermined stack height threshold, the amount of print media present in the input tray to be one of below and above the predefined amount of print media.

* * * * *